US008534330B2

(12) United States Patent
Hinchliff

(10) Patent No.: US 8,534,330 B2
(45) Date of Patent: Sep. 17, 2013

(54) KNIFE AND KNIFE ASSEMBLY FOR A PLANER SIDE HEAD

(75) Inventor: Thomas Charles Hinchliff, Sherwood, OR (US)

(73) Assignee: Key Knife, Inc., Tualatin, OR (US)

( * ) Notice: Subject to any disclaimer, the term of this patent is extended or adjusted under 35 U.S.C. 154(b) by 392 days.

(21) Appl. No.: 12/660,883

(22) Filed: Mar. 4, 2010

(65) Prior Publication Data

US 2011/0100510 A1 May 5, 2011

Related U.S. Application Data

(62) Division of application No. 11/824,305, filed on Jun. 29, 2007, now Pat. No. 7,891,388.

(51) Int. Cl.
*B27G 13/00* (2006.01)

(52) U.S. Cl.
USPC ..... 144/230; 144/174; 144/220; 144/373; 407/40; 241/293

(58) Field of Classification Search
USPC ..... 144/162.1, 174, 220, 373, 218, 221, 144/230, 235; 241/292.1, 293, 294; 407/40, 407/46, 47, 48
See application file for complete search history.

(56) References Cited

U.S. PATENT DOCUMENTS

| | | | | |
|---|---|---|---|---|
| 4,347,882 | A | 9/1982 | Bachmann | |
| 5,176,191 | A | 1/1993 | Owens | |
| 5,333,659 | A | 8/1994 | Carpenter et al. | |
| 5,709,255 | A * | 1/1998 | Toogood | 144/220 |
| 5,800,079 | A | 9/1998 | Qvarth | |
| RE36,659 | E | 4/2000 | Toogood | |
| 6,058,992 | A | 5/2000 | Stager et al. | |
| 6,167,929 | B1 | 1/2001 | Stager et al. | |
| 6,591,878 | B2 | 7/2003 | Hinchliff | |
| 6,757,952 | B1 | 7/2004 | Stager | |
| 2004/0168745 | A1 | 9/2004 | Stager | |
| 2006/0124200 | A1 * | 6/2006 | Stager | 144/241 |

OTHER PUBLICATIONS

Figs 1-11 of the present application.

* cited by examiner

*Primary Examiner* — Dana Ross
*Assistant Examiner* — Matthew G Katcoff
(74) *Attorney, Agent, or Firm* — Portland Intellectual Property, LLC

(57) ABSTRACT

A knife and knife assembly for a planer side head. An L or an LV type side planer head is retro-fitted with knives having substantially less mass than the knives originally provided for these heads.

13 Claims, 11 Drawing Sheets

Fig. 4
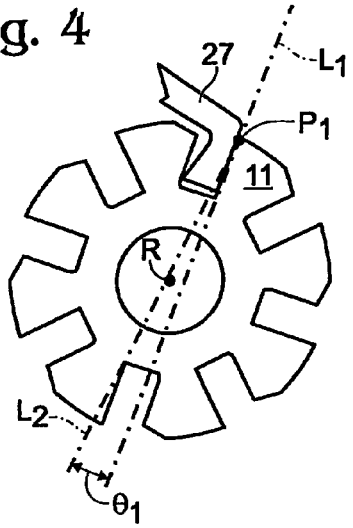
Fig. 5
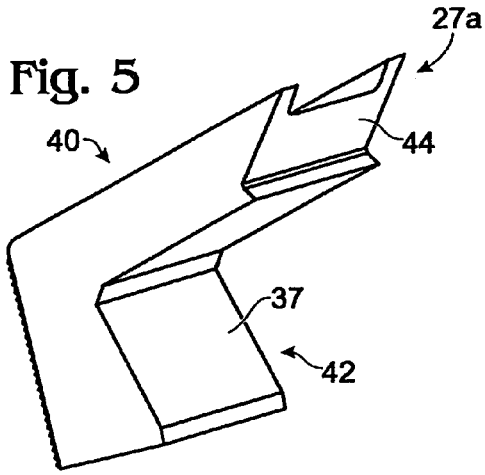
Fig. 6
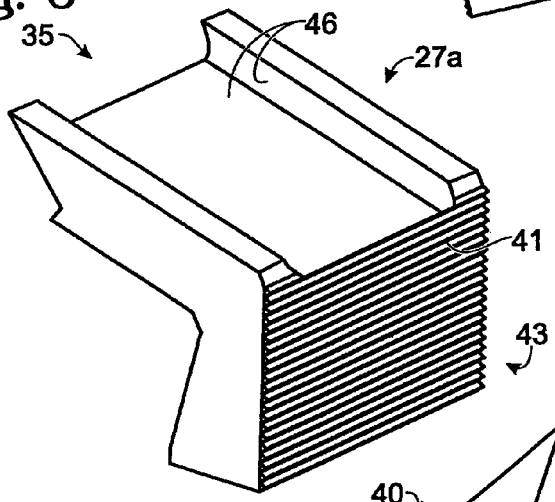
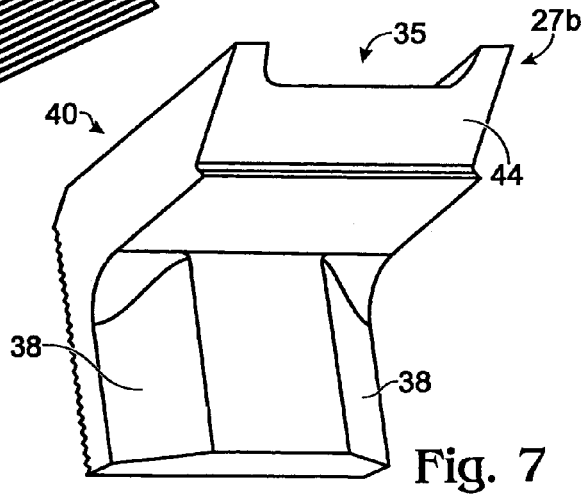
Fig. 7

KNIFE AND KNIFE ASSEMBLY FOR A PLANER SIDE HEAD

RELATED APPLICATIONS

This application is a divisional of U.S. Ser. No. 11/824,305, filed Jun. 29, 2007, now U.S. Pat. No. 7,891,388 which is incorporated by reference herein in its entirety.

FIELD OF THE INVENTION

The present invention relates to a knife and knife assembly for a high speed planer head, which is used in commercial manufacturing of construction lumber and finished wood products.

BACKGROUND

FIGS. 1 and 2 show typical, prior art planer side heads for use in commercial manufacturing of construction lumber and finished wood products. Such heads can generically be referred to as "cutting heads" because they produce cuts in the workpiece. They include, typically, a plurality of knives and are connected, typically by a drive-shaft, to a motor or engine that rotates the cutting head about an axis of rotation.

FIG. 1 shows a planer side head 10 known as an "L" type, and FIG. 2 shows a planer side head 20 known as an "LV" type. FIG. 3 shows for greater clarity wedging elements 24 (24*a*, 24*b*) that form part of a wedging bolt assembly for clamping a knife in the head 20. While persons of ordinary skill are, by definition, familiar with L and LV planer side heads, a brief description of some salient features of these heads is provided here for general understanding, and focus.

A planer side head has an essentially disc-shaped or cylindrical body 11, and is caused to rotate about a cylindrical axis of rotation of the head "R." Extending into the body are a plurality of axially extending pockets 25 that are uniformly and azimuthally spaced-apart along the circumference of the body as shown. These pockets are adapted to receive corresponding knives 27 (27*a* in FIGS. 1 and 27*b* in FIG. 2) that project cutting edges 35 outwardly from the pockets.

Each pocket 25 has a back surface 26 for receiving the knives 27. As it appears in the end view of FIG. 4 (corresponding to the L-type head of FIG. 1), this back surface is congruent with a line "$L_1$" that joins the circumference of the body 11 at a point "$P_1$." This line $L_1$ is aligned closely, i.e., to an angle $\theta_1$ that is within 5 degrees from another line "$L_2$" drawn through the same point $P_1$ and the axis of rotation R. This geometry is characteristic of an L or LV-type planer side head, and is for purposes herein considered to be a distinguishing characteristic with respect to other types of cutting apparatus.

FIGS. 5 and 6 show a knife 27*a* for use in the L-type planer side head of FIG. 1, and FIGS. 7 and 8 show a knife 27*b* for use in the LV-type head. As can be seen, the knives 27*a* and 27*b* vary only with respect to their adaptations for being mounted in the pockets and are otherwise essentially identical.

Referring to FIG. 9, each of the knives 27 has a cutting end 40 that projects at an angle from a shank end 42 that is received in a pocket, giving the knife an approximate "L" shaped configuration. The shank end 42 has a back surface 43 that is received by the back surface 26 of the pocket in which the knife is installed. As can be seen particularly in FIGS. 6 and 8, the back surface 43 of the shank 42 has a series of axially disposed corrugations 41 that mate with corresponding corrugations 45 in the back surface 26 of the pocket (FIGS. 1 and 2). These corrugations are provided for incrementally adjusting the radial position of the cutting edge 35 of each knife 27, as discussed below.

Referring to FIG. 10, the cutting end 40 has a cutting edge 35 that includes a face-cutting edge portion 37 disposed between two corner-cutting edge portions 39 (39*a*, 39*b*). Each knife 27, when mounted into the planer side head and rotated, produces a cut in an article of wood 8 (or other material) having the profile "PR."

To produce a planer face-cut "$F_s$," the face-cutting edge portion of the cutting edge 35 is linear, and to produce the two arcuate corner cuts "r," the corner-cutting edge portions of the cutting edge 35 are preferably circular arcs, for producing radius cuts, although other curvatures could be provided in one or both of the corner-cutting edge portions to produce any desired arcuate corner cuts.

The cutting edge 35 is a line or edge of joinder of a planar front side surface 44 (see FIGS. 5 and 7) of the cutting end 40, facing the direction of rotation of the side head, and a back side surface 46 of the knife (see FIGS. 6 and 8). Referring to FIG. 11 (corresponding to the L-type head of FIG. 1), the front side surface 44 (shown in edge view) defines a cutting angle $\theta_C$ with a line intersecting an outermost tip 46 of the knife and the axis of rotation R. This cutting angle is an important process parameter, and in both the L and LV-type planer side heads it has a standard, industry accepted value which is assumed for descriptive purposes herein to be 25+10/−20 degrees.

A grinder is used to grind the front side surface 44 of a knife 27 to refresh or recondition the knife, but this causes the cutting edge 35 to recede in both azimuthal and radial directions, changing primarily the cutting diameter of the planer head, but also changing secondarily the cutting angle. However, the recessions in both directions are found to be satisfactorily compensated for by moving the knife outwardly along the aforementioned line $L_1$ (FIG. 4) in increments defined by the aforementioned corrugations.

The shank end 42 of the knives 27 provide the necessary adaptation for mounting the knife in the particular type of planer side head. Referring to FIGS. 1 and 6, the shank end 42 of the knife 27*a* for use in the L-type side planer head includes a, typically, planar front surface 37. Toe bolts 41 are threadably received in the body 11 so that ends 14 of the bolts extend into the associated pockets 25 by adjustable amounts. The ends 14 make contact with the front surface 37 and, by tightening the bolts, the knife 27*a* is clamped firmly in place.

Referring to FIGS. 2 and 8, in the LV-type planer side head, a more dense knife spacing is provided by the use of axially extending wedge bolts 22 used to draw together wedge elements 24 (24*a*, 24*b*) against axially opposed, relatively inclined sides 38 of a knife 27*b*. Tightening the axially extending wedge bolts wedges the knife firmly in place.

Aside from the differences in how the knives 27 are adapted for being clamped in the pockets, the L and LV type planer side heads are essentially identical for purposes herein.

SUMMARY OF THE INVENTION

According to one aspect of the invention, an L or an LV type side planer head is retro-fitted with knives having substantially less mass than the knives originally provided for these heads. Corresponding knife carriers are provided for clamping the smaller knives, and the knife carriers are installed in the pockets and clamped into the body of the side planer head in the ordinary manner.

According to another aspect of the invention, a knife assembly is used in a cutting apparatus providing for rotation of the knife assembly about an axis. The assembly includes a knife and a knife carrier. The knife carrier has a slot defining two cantilevered portions: A front cantilevered portion bears against a front side surface of a knife that faces the direction of rotation, and a back cantilevered portion bears against a back side surface of the knife which faces the opposite direction. One or more clamping bolts are employed for drawing the front and back cantilevered portions together so as to firmly clamp the knife therebetween.

According to yet another aspect of the invention, a knife is provided for use in a cutting apparatus providing for rotation of the knife about an axis. The knife has a front side surface for facing the direction of rotation and a back side surface facing the opposite direction and parallel to the front side surface. The knife has a cutting edge that has a linear, face-cutting edge portion disposed between two opposed corner-cutting edge portions. Each corner-cutting edge portion has associated therewith a first beveled, knife-edge forming surface that joins the back side surface and the respective corner-cutting edge portion. The knife-edge forming surfaces define a constant relief angle in the range of 25-40 degrees over substantially the full extent of the corner-cutting edge portions. The face-cutting edge portion has associated therewith a second beveled, knife-edge forming surface that joins the back side surface and the face-cutting edge portion. The second knife-edge forming surface is planar over substantially the full extent of the face-cutting edge portion. The cutting edge is provided at one end of the knife and the extreme opposite end of the knife has a planar knife seating surface, parallel to the face-cutting edge portion, for seating the knife in the cutting apparatus.

A method according to the invention is disclosed for repairing a cutting head having a damaged knife on a cutting head that is operatively connected to a drive means for rotating the cutting head and the knife about an axis of rotation. The method comprises removing and replacing the knife while the cutting head remains operatively connected to the drive means.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

BRIEF DESCRIPTION OF THE DRAWINGS

FIG. 4 is a side elevation of the L-type planer side head of FIG. 1.

FIG. 5 is a front side pictorial view of a prior art knife for use in the L-type planer side head of FIG. 1.

FIG. 6 is a back side pictorial view of the knife of FIG. 5.

FIG. 7 is a front side pictorial view of a prior art knife for use in the LV-type planer side head of FIG. 2.

DETAILED DESCRIPTION OF A PREFERRED EMBODIMENT

FIGS. 12-18 show a preferred knife 50, and FIGS. 12-15 and 19-21 show a preferred knife carrier 52, which together are intended to replace one of the knives 27*a* described above in the L-type planer side head.

Figure 12:
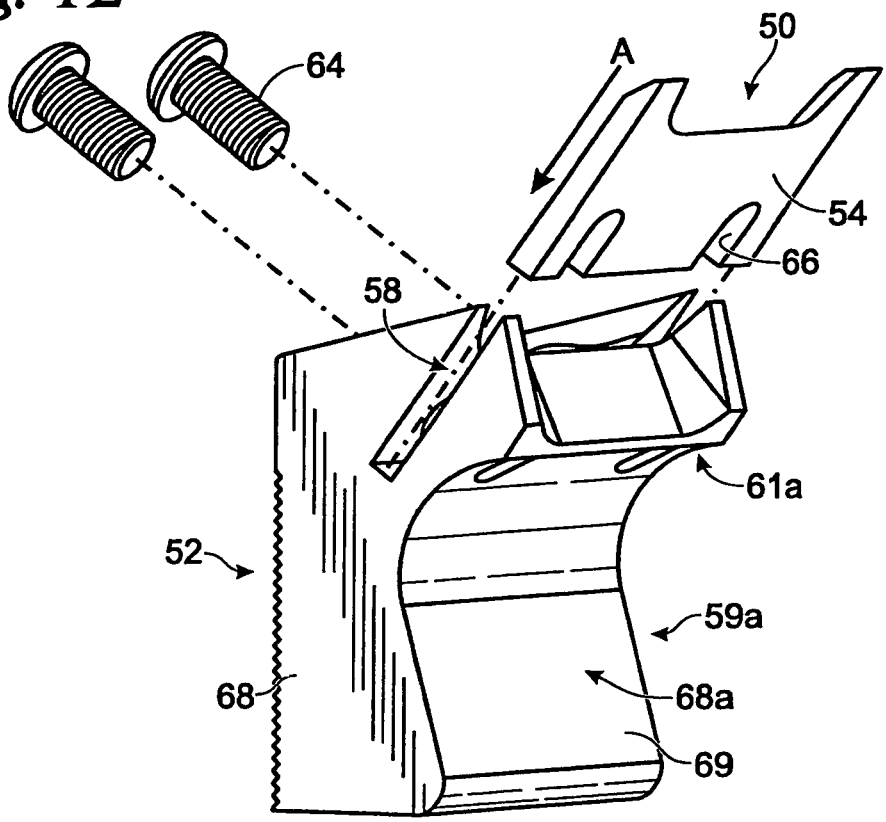
FIG. 12 is a front side, exploded pictorial view of a knife and knife carrier according to the present invention.
Figure 16:
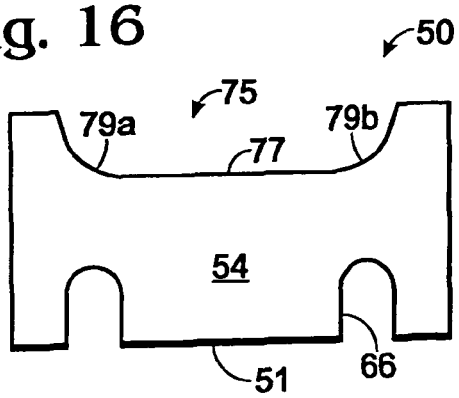
FIG. 16 is a front side view of the knife of FIGS. 12-15.

FIGS. 12 and 16 show a front side 54 of the knife 50, corresponding to the front side surface 44 of the prior art knives (see FIGS. 5 and 7). The front side 54 is preferably planar and faces in the direction of rotation of the planer side head.

Figure 13:
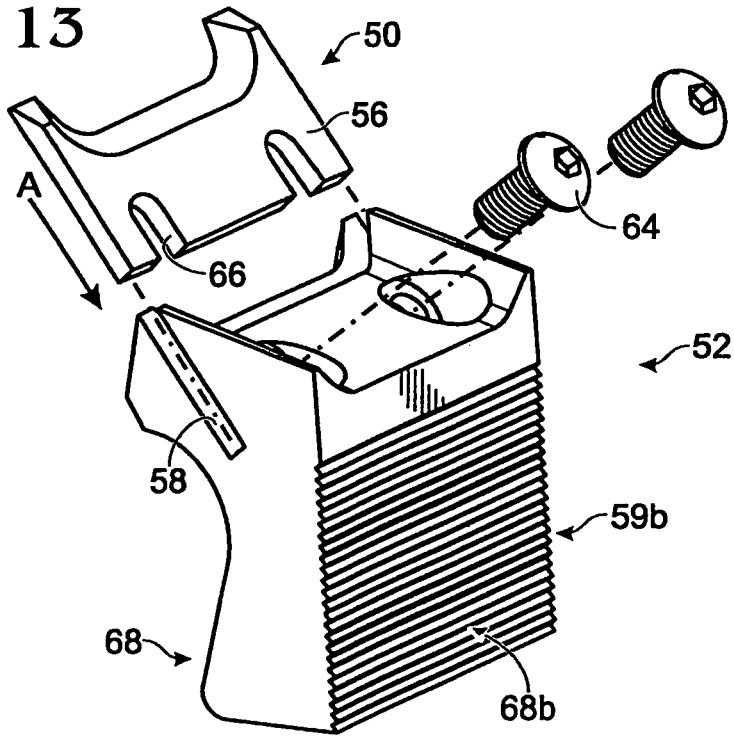
FIG. 13 is a back side, exploded pictorial view of the knife and knife carrier of FIG. 12.
Figure 18:
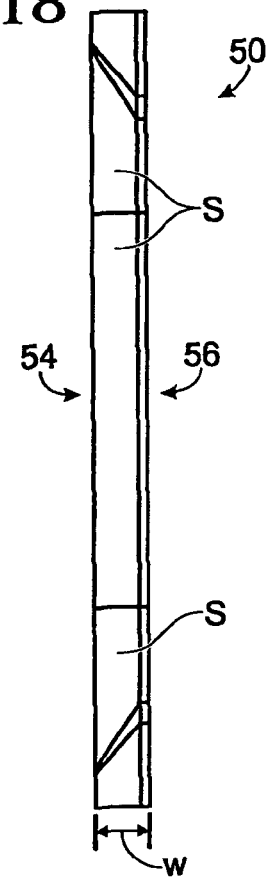
FIG. 18 is side elevation of the knife of FIGS. 12-15, taken along a line 18-18 in FIG. 17.
Figure 17:
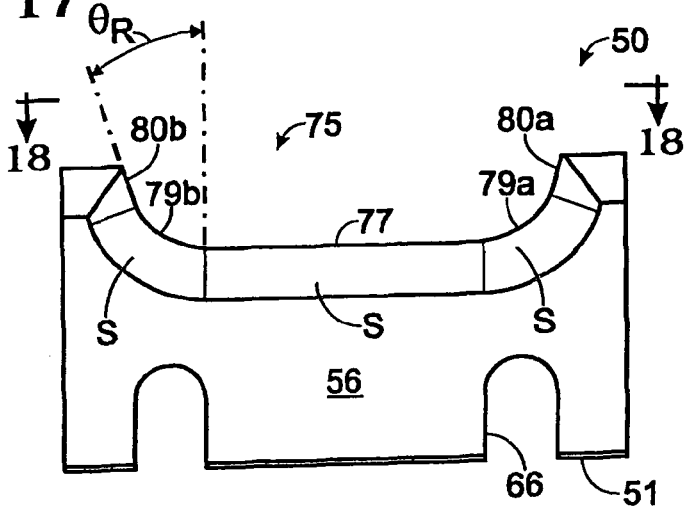
FIG. 17 is a back side view of the knife of FIGS. 12-15.
Figure 19:
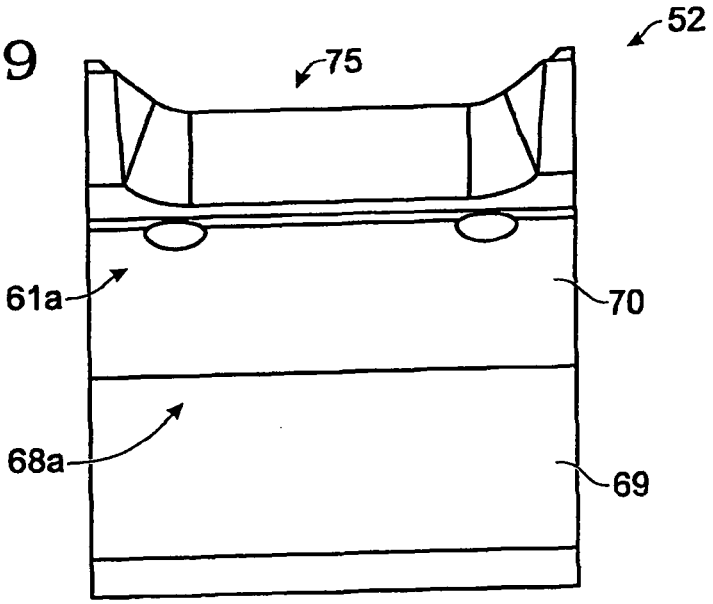
FIG. 19 is a front side view of the knife carrier of FIGS. 12-15.
Figure 20:
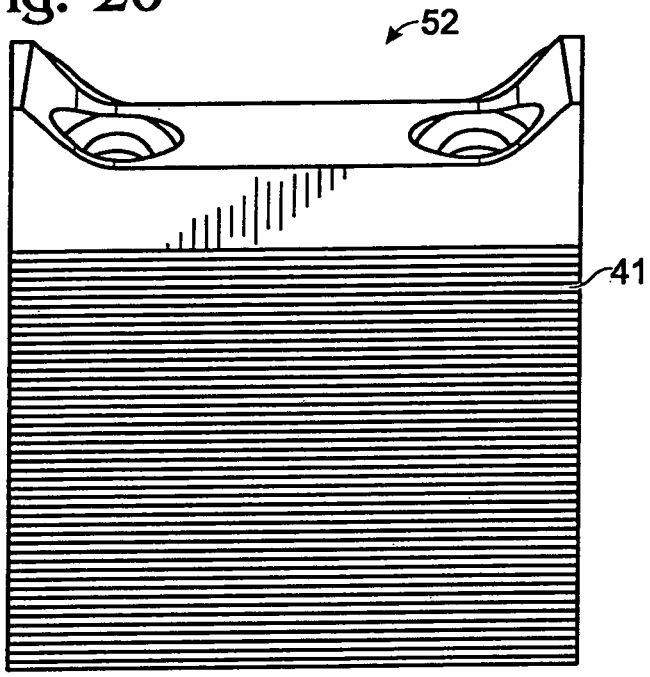
FIG. 20 is a back side view of the knife carrier of FIGS. 12-15.

FIGS. 13 and 17 show a back side 56 of the knife 50, which is opposite the front side 54, is also preferably planar, and is preferably parallel to the front side, as seen in FIG. 18, showing a side elevation and defining a width "w" of the knife.

With particular reference to FIG. 17, the knife 50 has a cutting edge 75 that includes a linear face cutting edge portion 77 disposed between two arcuate corner-cutting edge portions 79 (79*a*, 79*b*). The purpose of the face and corner-cutting portions is the same as described above for the prior art knives 27. The knife also has approximately linear (though linearity is not essential) side relief portions 80 (80*a*, 80*b*) that are not actually used to make a cut but provide clearance to avoid undesirable interference with the wood (or other object or article) and thus provide an outstanding advantage over the prior art. The relief portions 80 in the preferred embodiment make an angle $\theta_R$ with a line perpendicular to the face cutting portion 77 that is preferably 20+5/−10 degrees.

Figure 14:
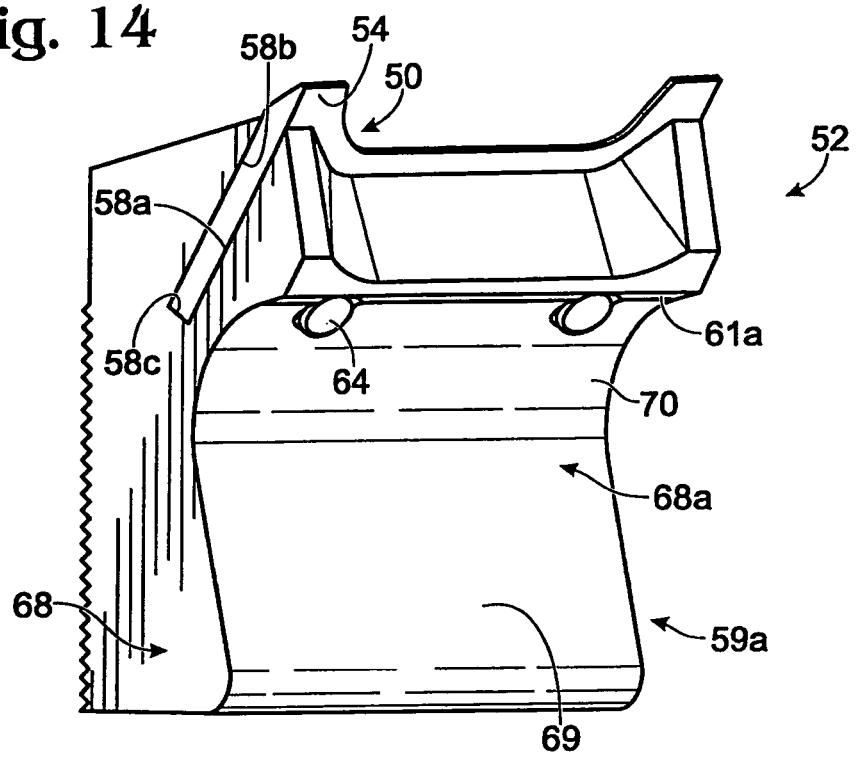
FIG. 14 is a front side, pictorial view of the knife carrier and knife of FIG. 12, showing the knife installed.
Figure 15:
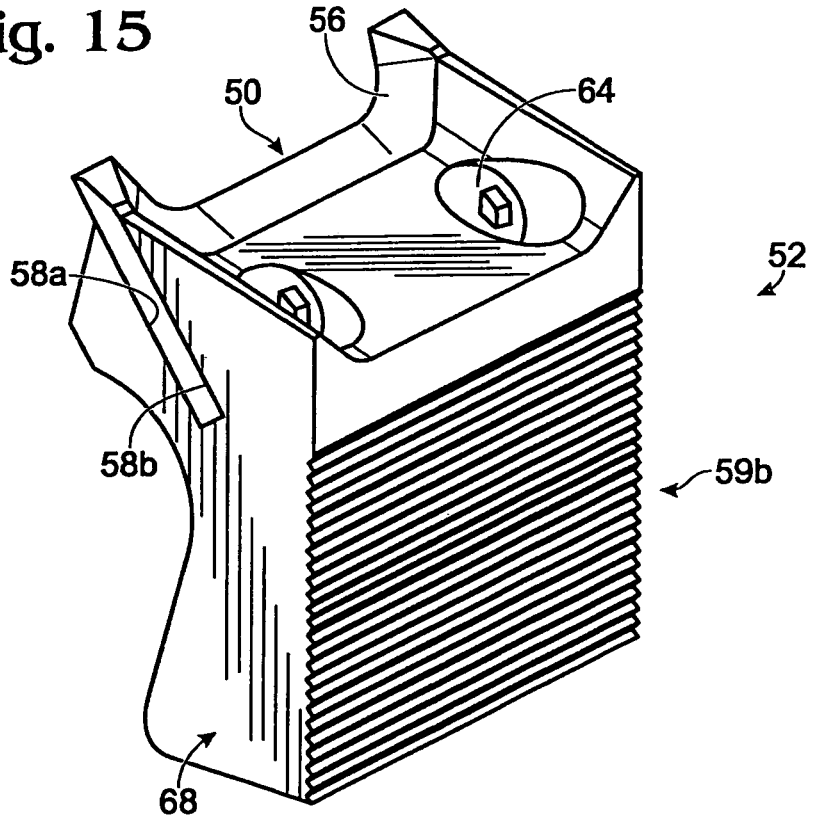
FIG. 15 is a back side, pictorial view of the knife carrier and knife of FIG. 13, showing the knife installed.

Referring back to FIGS. 12-15, the knife 50 fits into a knife carrier slot 58 defined in the knife carrier 52. The knife carrier is preferably an integral block of metal into which the knife carrier slot is cut; however, this is not essential. The knife carrier has a front side 59*a* (FIGS. 12 and 14) and a back side 59*b* (FIGS. 13 and 15).

Figure 21:
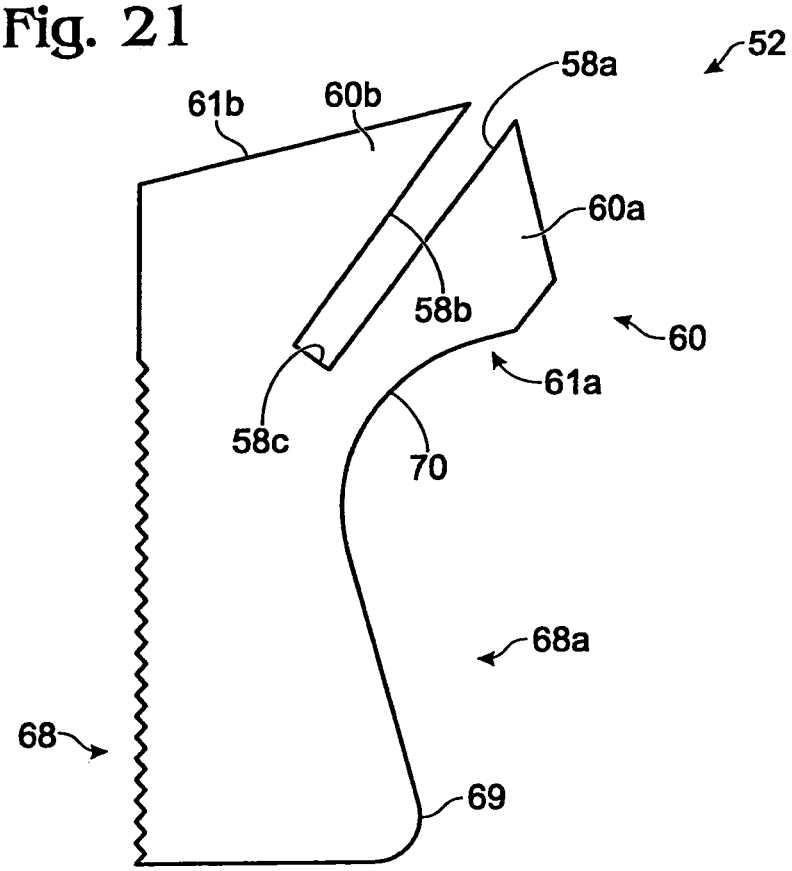
FIG. 21 is a side elevation of the knife carrier of FIGS. 12-15, taken along a line 21-21 in FIG. 20.

Turning now to FIG. 21, the knife carrier slot 58 defines two cantilevered portions 60 of the knife carrier. A front cantilevered portion 60*a* bears, along a front internal surface 58*a* of the slot, against the front side 54 of the knife 50 (see FIG. 14). Correspondingly, a back cantilevered portion 60*b* bears, along a back internal surface 58*b* of the slot, against the back side 56 of the knife (see FIG. 15). The knife carrier slot is slightly wider than the width w of the knife so that the knife can be slid into the slot manually, without the exertion of any significant force.

The front and back cantilevered portions 60*a* and 60*b* define respective outer surfaces 61*a* and 61*b*.

The cantilevered portions, by virtue of being cantilevered, are adapted to bend toward one another and thereby clamp the knife 50 with a frictional force exerted on both the front and back sides of the knife by the internal surfaces 58*a*, 58*b*. This bending is caused by tightening one or more clamping bolts 64 as shown in FIGS. 14 and 15. In the preferred embodiment, the clamping bolts 64 extend through the back cantilevered portion 60*b*, and through slots 66 in the knife (see FIGS. 12 and 13) corresponding to the one or more clamping screws 64, and are threaded into threaded holes in the front cantilevered portion 60*a*. This orientation allows access to the bolt-heads from the outer periphery of the side head and providing the threads in the knife carrier eliminates the need for nuts on the ends of the bolts. The slots 66 in the knife 50 allow the knife to be slid into and out of the knife carrier slot 58 in the direction of the arrow "A" in FIGS. 12 and 13, merely by loosening the clamping screws 64, without the need to remove the clamping bolts. However, it should be understood that numerous alternative clamping schemes and configurations of the knife and knife carrier allowing for clamping the knife 50 as a result of bending the cantilevered portions could be employed without departing from the principles of the invention.

The knife carrier 52 shown in FIGS. 12-15 and 19-21 has a shank 68 adapted to fit an L-type planer side head. The shank has a front surface 68*a* and an opposed, back surface 68*b*. The front surface 68*a* preferably has a planar distal end portion 69 for receiving the ends of the aforementioned toe bolts 40, and preferably joins with the front cantilevered portion 60*a* with a cylindrical surface portion 70 of substantial radius such as shown. This radius is positioned where the largest bending forces are encountered, and is preferred because it provides a configuration that reduces stress concentration.

Taken together, the front surface 68*a* of the shank 68, the cylindrical surface portion 70, and the outer surface 61*a* of the front cantilevered portion define the front side 59*a* of the knife carrier 58. It will be appreciated that this entire front side 59*a* may have numerous alternative configurations providing for (a) clamping the knife carrier in the pocket of the planar side head, and (b) cantilevered portions for clamping the knife, without departing from the principles of the invention.

The back surface 68*b* of the shank 68 preferably includes the same corrugations 41 (see, e.g., FIG. 20) provided in the prior art knives 27 as described above.

Referring to FIGS. 14 and 21, the knife carrier slot 58 has an internal surface 58*c* that registers to a corresponding knife seating surface 51 of the knife 50 (see FIGS. 16 and 17), to seat the knife in the slot so that the cutting edge 75 of the knife extends from the planar side head a predetermined amount. This predetermined amount is also adjustable in increments where the aforementioned axially disposed corrugations are provided, which allow for moving the knife carrier relative to the axis of rotation R of the side planer head in essentially radial directions.

The internal surface 58*c* of the knife carrier slot is preferably a simple planar bottom surface of the slot, and the corresponding knife seating surface is preferably a simple planar side of the knife that is also, preferably, perpendicular to the front and back sides 54 and 56 of the knife, but other registration features as known in the art positioned in other locations of the knife and knife carrier slot may be employed for seating the knife in the slot without departing from the principles of the invention.

Figure 1:
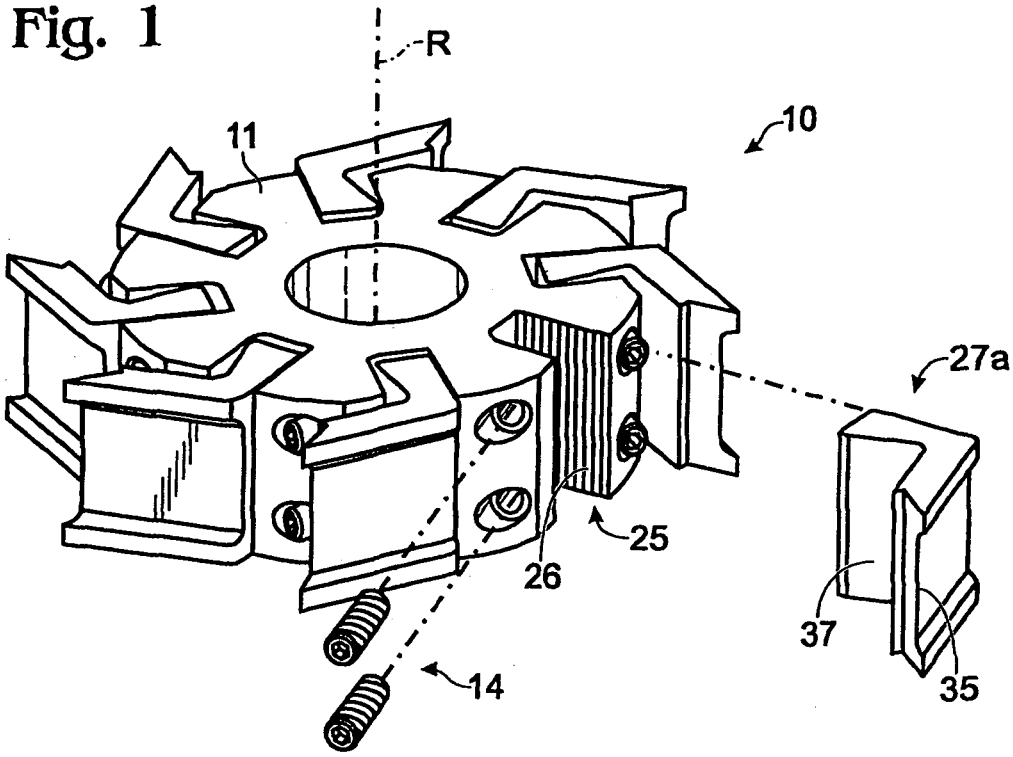
FIG. 1 is a pictorial view of a prior art L-type planer side head.
Figure 3:
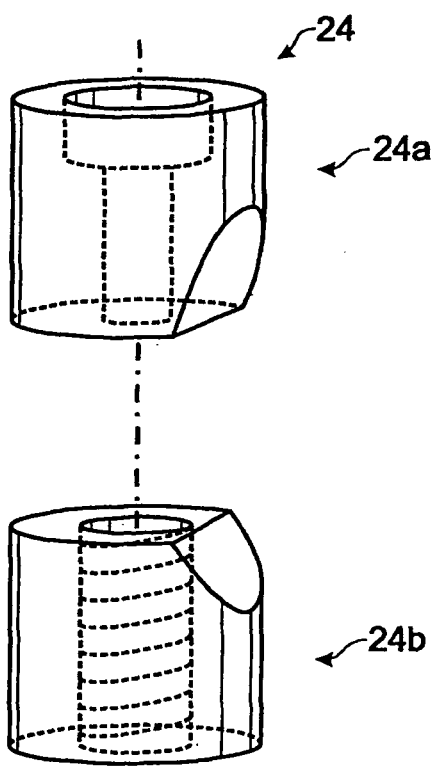
FIG. 3 is a pictorial view of wedge elements that form part of a wedging bolt assembly for clamping a knife in the LV-type planer side head of FIG. 2.
Figure 2:
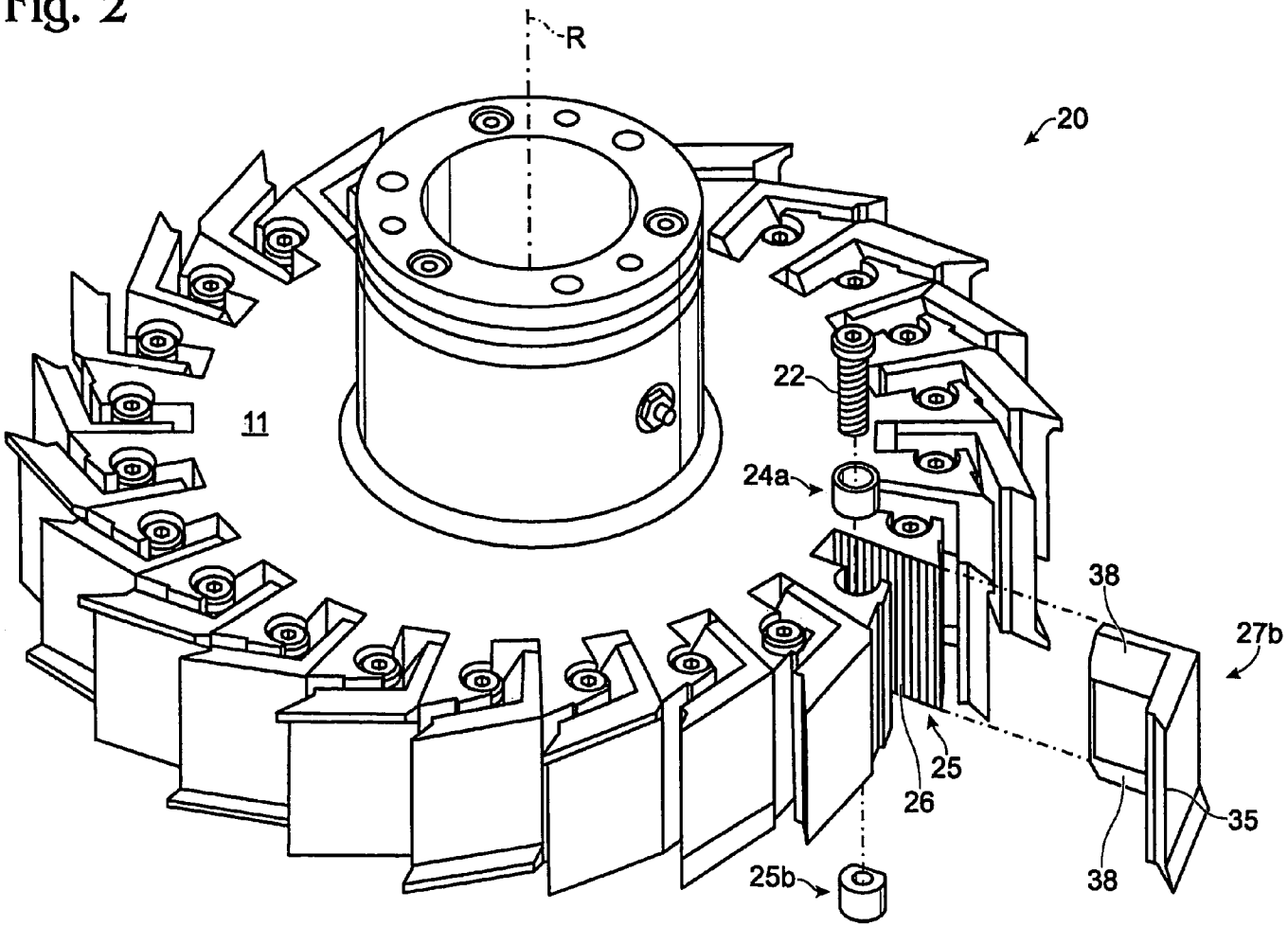
FIG. 2 is a pictorial view of a prior art LV-type planer side head.
Figure 8:
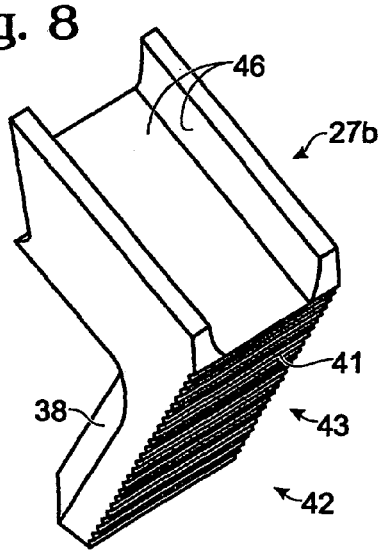
FIG. 8 is a back side pictorial view of the knife of FIG. 7.
Figure 9:
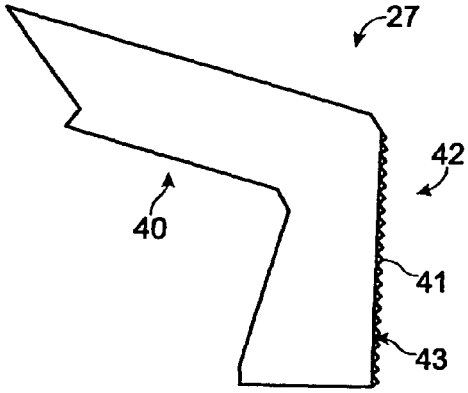
FIG. 9 is a side elevation of the knife of FIGS. 5 and 6.
Figure 11:
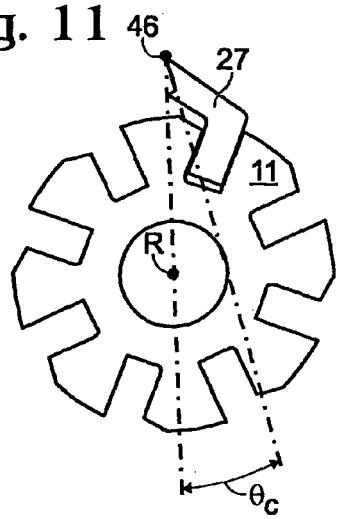
FIG. 11 is a side elevation of a generalized planer side head and knife.
Figure 10:
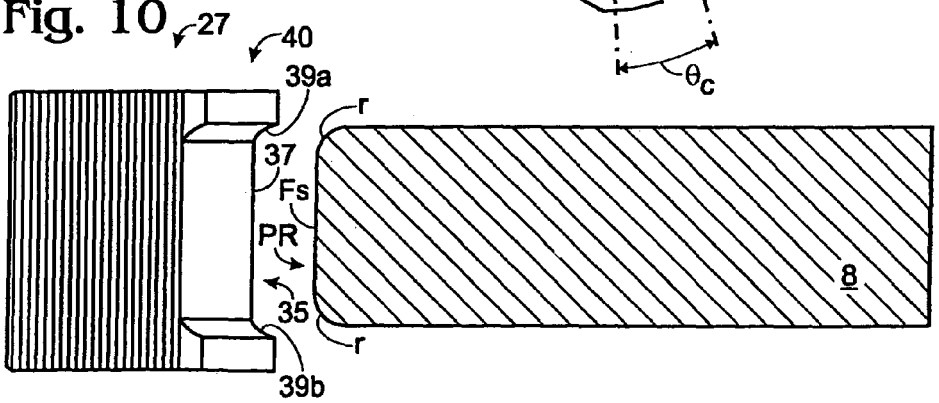
FIG. 10 is a top view of the knife of FIGS. 5 and 6 cutting an article of wood.
Figure 22:
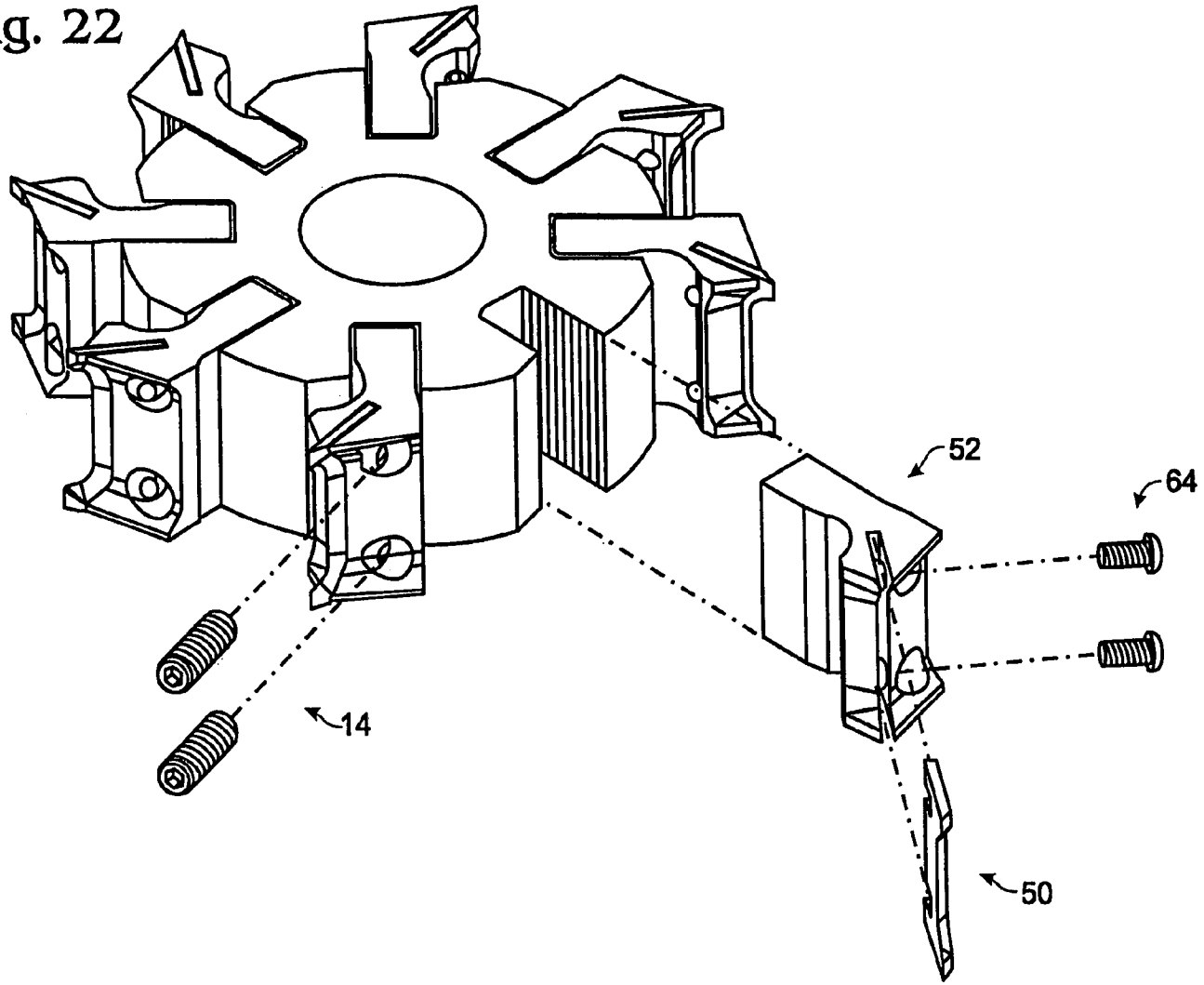
FIG. 22 is a pictorial view of an L-type planer side head employing the knife and knife carrier of FIGS. 12-21.
Figure 23:
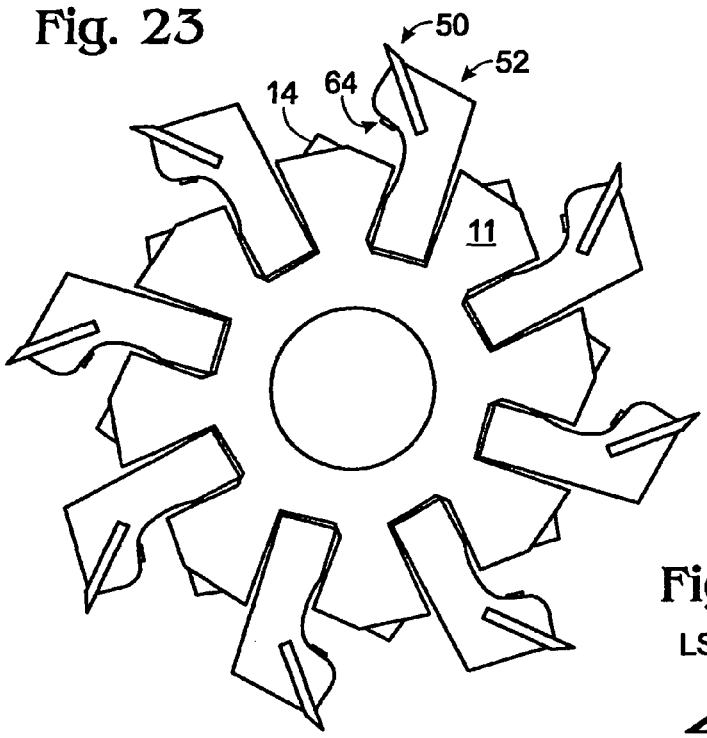
FIG. 23 is a side elevation of the planer side of FIG. 22.

FIGS. 22 and 23 show the knife 50 and knife carrier 52 installed in the L-type planer side head of FIG. 1, where instances of the knife 50 and knife carrier 52 are used as replacements for corresponding instances of the prior art knives 27*a*. From FIG. 23, it can be appreciated that the knife carrier slot 58 is angled and positioned so that, in addition to establishing the depth of seating of the knife in the knife carrier, the knife carrier slot establishes the aforementioned cutting angle $\theta_C$ for the knife.

Figure 24:
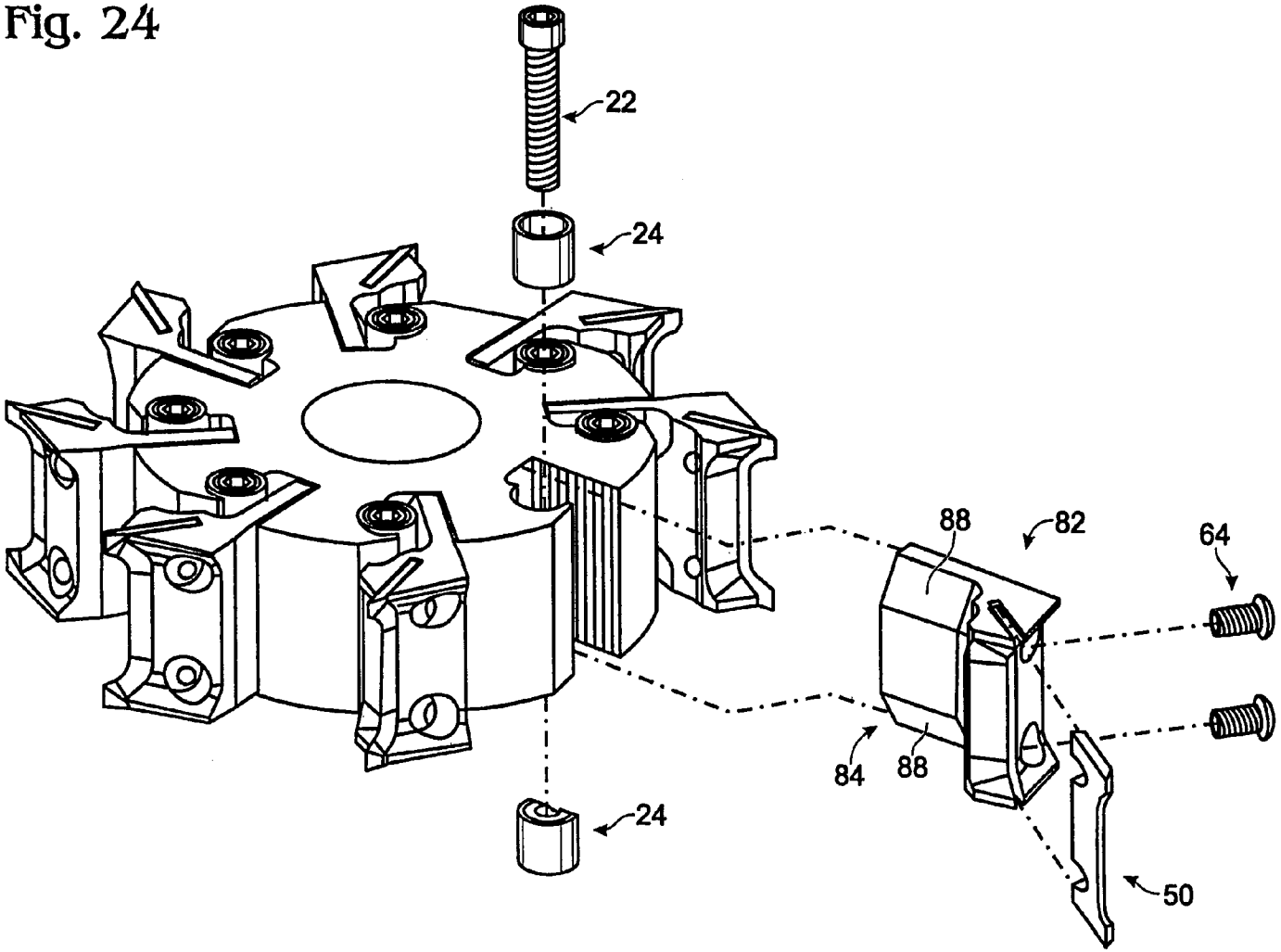
FIG. 24 is a pictorial view of an LV-type planer side head employing the knife and knife carrier of FIGS. 12-21.

FIG. 24 shows the knife 50 in a knife carrier 82 adapted particularly for use in the LV-type planer side head. The only difference between the knife carrier 82 and the knife carrier 52 is the adaptation of the shank, here 84, to include axially opposed, relatively inclined sides 88, for cooperation with the aforementioned axially extending wedge bolts 22 and wedge elements 24.

In consideration of FIGS. 25-28, FIG. 16 shows the knife 50 looking toward the front side 54 and FIG. 17 shows the knife looking toward the back side 56. With additional reference to FIG. 18, the cutting edge 75 is formed by joinder of the front side 54 and a beveled or canted surface "S" that, in turn, joins the back side 56.

Figure 26:
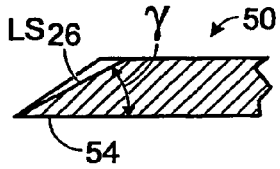
FIG. 26 is a section view of the knife of FIG. 25, taken along a line 26-26 thereof.
Figure 25:
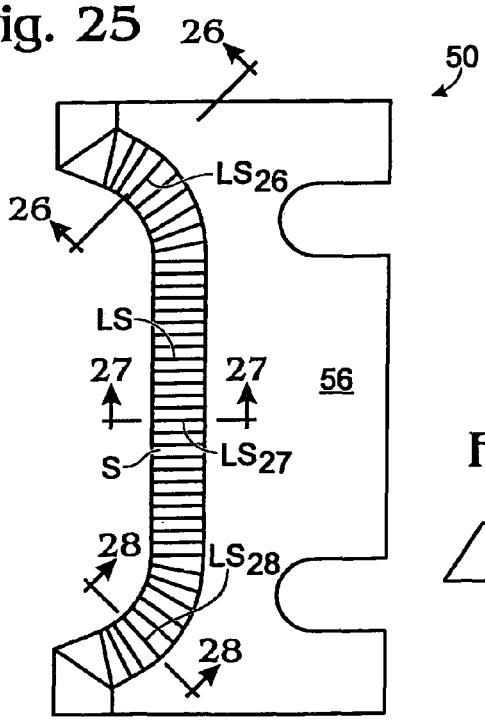
FIG. 25 is a partially cut-away, back side view of the knife of FIGS. 12-18.
Figure 27:
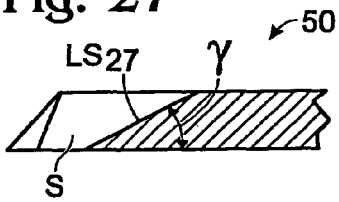
FIG. 27 is a section view of the knife of FIG. 25, taken along a line 27-27 thereof.
Figure 28:
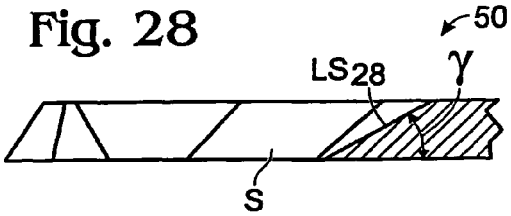
FIG. 28 is a section view of the knife of FIG. 25, taken along a line 28-28 thereof.

Turning now to FIGS. 25-28, the surface S can be visualized as a series of line segments "LS" that define a "relief angle" $\gamma$ with the front side 54. FIGS. 26-28 show this angle taken as various cross-sections indicated. The line segments LS lie in planes that are perpendicular to the cutting edge 36 and the front side 54. The relief angle $\gamma$ is preferably in the range of 25-40 degrees, and is also preferably constant over the entire surface S, including those portions of the surface S corresponding to the corner-cutting edge portions 79. By comparison, the prior art knives 27 did not provide the equivalent of a relief angle adjacent the corner-cutting portions of the cutting edge, which increasing the risk of tearing the wood as it is being cut.

The knife carriers 52 and 82 provide for retrofitting an existing L or LV type side planer head for use with a knife 50, which provides a number of outstanding advantages. The knife is small enough, typically about 1"×2"×0.125", to be economical to dispose of when the cutting edge becomes dull. The small size eliminates the need to grind the knife, and therefore the need to keep, maintain and utilize a grinding machine.

Moreover, because knives according to the invention are relatively small, they can be held in place by commensurately small clamping screws (see, e.g., FIG. 13 and clamping screws 64, noting that the figure is drawn to scale). Thus, it becomes an attractive option to remove the knives for replacement while the cutting head is in place, saving time and effort.

By contrast, the relatively large, heavy knives of the prior art are much more difficult to remove individually, justifying the standard practice of removing the entire cutting head when the knives need to be ground or replaced.

Often just one or only a few knives become damaged as a result of contact with a small rock, or a small piece of metal scrap. In this circumstance, there is an additional reason that the entire cutting head is typically removed to effectuate repair. That is that the relatively large, heavy prior art knives are susceptible to sufficient variation in mass that replacing just one of them can throw the cutting head out of balance. Thus, it is standard practice, when one or just a few knives are damaged, to replace all of the knives. At the least, corresponding knives on the opposite side of the cutting head would typically need to be replaced to maintain balance, doubling the replacement requirements and consequently tending to justify the time and effort involved in removing the entire cutting head.

It is therefore an outstanding advantage that a knife according to the present invention can be replaced with another knife of non-identical mass with relatively little impact on balance, simply because each knife has so little mass by comparison to that of the entire cutting head. Thus, if only one or a few knives are damaged, it is practical to replace them without concern for affecting the balance of the cutting head, tending to justify making the repair with the cutting head in place.

It is further recognized that clamping the knife by use of cantilevered portions, whether provided as part of a knife carrier or as part of the body of the planer head itself, is a particularly low profile means for clamping a knife and may have uses in many other applications, including other types of cutting apparatus, such as chipper discs and drum chippers, as well as other types of planer heads.

It is still further recognized that the knife described herein is particularly advantageous in any side planer head due to the provision of the constant relief over the surface S in conjunction with a single-sided knife that uses one side for registering the knife in a slot or pocket, independent of how the knife is clamped therein or thereby.

It is to be recognized that, while a particular knife and knife assembly for a side planer head has been shown and described as preferred, other configurations and methods could be utilized, in addition to those already mentioned, without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. A knife assembly for use in an apparatus providing for rotation of the knife assembly about an axis, comprising:

a knife; and a knife carrier having a slot defining in said knife carrier a front cantilevered portion for bearing against a front side surface of said knife facing the direction of rotation and a back cantilevered portion for bearing against a back side surface of said knife facing opposite the direction of rotation, and one or more clamping bolts arranged to bend said front and back cantilevered portions toward one another sufficiently to firmly clamp said knife therebetween.

2. The knife assembly of claim 1, said knife having a front side surface for bearing against said front cantilevered portion of said knife carrier and a back side surface for bearing against said back cantilevered portion of said knife carrier, said front and back side surfaces of said knife being parallel to each other.

3. In the planer head of claim 1, said knife having a cutting edge and a knife seating surface cooperating with a surface of said slot to seat said knife in said slot at a predetermined depth, for positively locating said cutting edge relative to the axis of rotation.

4. In the planer head of claim 3, said cutting edge being disposed at one side of said knife and said knife seating surface being disposed at the extreme opposite end of said knife.

5. In the planer head of claim 1, said knife having a cutting edge with a linear, face-cutting edge portion, and a beveled, knife-edge forming surface that joins said front side surface and said face-cutting edge portion, said knife-edge forming surface being planar over substantially the full extent of said face-cutting edge portion.

6. In the planer head of claim 5, said knife-edge forming surface being angled with respect to said front side surface by a relief angle in the range of 25-40 degrees.

7. In the planer head of claim 1, said knife having a cutting edge with a linear, face-cutting edge portion disposed between two opposed corner-cutting edge portions, each corner-cutting edge portion having associated therewith a first beveled, knife-edge forming surface that joins said back side surface and the respective corner-cutting edge portion, said first knife-edge forming surfaces defining a constant relief angle in the range of 25-40 degrees over substantially the full extent of said corner-cutting edge portions.

8. In the planer head of claim 7, the face-cutting edge portion having associated therewith a second beveled, knife-edge forming surface that joins said back side surface and said face-cutting edge portion, said second knife-edge forming surface being planar over substantially the full extent of said face-cutting edge portion.

9. In the planer head of claim 1, said knife carrier having a back surface including a first sequence of axially aligned and radially spaced-apart corrugations, to assist in gripping said knife carrier at incrementally adjustable locations.

10. A cutting apparatus and knife for use in the cutting apparatus for mounting the knife and rotating about an axis, the knife having a front side surface for facing the direction of rotation and a back side surface facing opposite the direction of rotation, and a cutting edge with a linear, face-cutting edge portion disposed between two opposed corner-cutting edge portions, each corner-cutting edge portion having associated therewith a first beveled, knife-edge forming surface that joins said back side surface and the respective corner-cutting edge portion, said knife-edge forming surfaces defining a constant relief angle in the range of 25-40 degrees over substantially the full extent of said corner-cutting edge portions, and the face-cutting edge portion having associated therewith a second beveled, knife-edge forming surface that joins said back side surface and said face-cutting edge portion, said second knife-edge forming surface being planar over substantially the full extent of said face-cutting edge portion, said cutting edge being provided at one end of the knife and the extreme opposite end of the knife having a planar knife seating surface, parallel to said face-cutting edge portion, for resting the knife against the cutting apparatus.

11. The cutting apparatus and knife of claim 10, wherein said knife seating surface is substantially perpendicular to said front and back sides.

12. The cutting apparatus and knife of claim 11, wherein said second beveled, knife-edge forming surface defines the same relief angle as said first knife-edge forming surface.

13. The cutting apparatus and knife of claim 10, wherein said second beveled, knife-edge forming surface defines the same relief angle as said first knife-edge forming surface.

* * * * *